US009085913B2

(12) United States Patent
Rühmann et al.

(10) Patent No.: US 9,085,913 B2
(45) Date of Patent: Jul. 21, 2015

(54) GRANDSTAND

(75) Inventors: Lars Rühmann, Hamburg (DE); Tim Schierwater, Hamburg (DE); Timothy Pape, Berlin (DE); Mark Höfler, Berlin (DE)

(73) Assignee: INTER+-POL FREIE FORSCHUNGS- UND ENTWICKLUNGSGESELLSCHAFT FUR UNFASSBARE FORMATE, EXPERIMENTELLE PROJEKTE, UNGESEHENE FILME, DICKE UND DUNNE BUCHER, GRENZENLOSE RAUME, ANGEWANDTE STREITKULTUR UND LDEEN AUS FERNER ZUKUNFT MBH, Hamburg (DE)

( * ) Notice: Subject to any disclaimer, the term of this patent is extended or adjusted under 35 U.S.C. 154(b) by 0 days.

(21) Appl. No.: 13/566,477

(22) Filed: Aug. 3, 2012

(65) Prior Publication Data

US 2013/0219803 A1 Aug. 29, 2013

(30) Foreign Application Priority Data

Feb. 3, 2012 (EP) ..... 12153956

(51) Int. Cl.
*E04H 3/12* (2006.01)

(52) U.S. Cl.
CPC ..... *E04H 3/12* (2013.01)

(58) Field of Classification Search
CPC ..... E04H 3/10; E04H 3/12; E04H 3/22; E04H 3/30
USPC ..... 52/6–10, 126.1, 109; 254/93 R, 134; 182/132, 223
See application file for complete search history.

(56) References Cited

U.S. PATENT DOCUMENTS

| | | | | | |
|---|---|---|---|---|---|
| 663,950 | A | * | 12/1900 | Williams | 52/8 |
| 746,345 | A | * | 12/1903 | Kubbernuss | 52/8 |
| 1,660,263 | A | * | 2/1928 | Fowler | 52/8 |
| 1,957,947 | A | * | 5/1934 | Dreyfuss | 52/6 |
| 2,831,217 | A | * | 4/1958 | Lombardo | 52/6 |
| 3,168,761 | A | * | 2/1965 | Graf | 52/9 |
| 3,263,380 | A | * | 8/1966 | Bourbonnais | 52/64 |
| 3,975,869 | A | * | 8/1976 | Bouton | 52/9 |
| 5,622,013 | A | * | 4/1997 | Ban et al. | 52/83 |
| 6,293,052 | B1 | * | 9/2001 | Varnado, Jr. | 52/7 |
| 6,474,023 | B1 | * | 11/2002 | Takeuchi | 52/8 |
| 6,820,374 | B2 | * | 11/2004 | Schworer | 52/7 |
| 6,915,610 | B2 | * | 7/2005 | Stark et al. | 52/6 |
| 8,407,943 | B2 | * | 4/2013 | Sudkamp et al. | 52/10 |

FOREIGN PATENT DOCUMENTS

| | | | |
|---|---|---|---|
| DE | 102004045403 | B4 | 4/2010 |
| JP | 03206268 | A * | 9/1991 |

* cited by examiner

*Primary Examiner* — Jeanette E Chapman
(74) *Attorney, Agent, or Firm* — Scott R. Cox

(57) ABSTRACT

The invention relates to a grandstand having a plurality of seat rows and/or standing space rows which rise in a stepped manner and are accessible via at least one access route which bridges the height difference between the seat rows and/or standing space rows, the gradient of the seat rows and/or standing space rows and the gradient of the access route enclosing an angle of from approximately 20° to approximately 90°, with the result that the gradient of the access route has a first component which runs parallel to the direction of the space rows and runs towards the space rows.

26 Claims, 5 Drawing Sheets

GRANDSTAND

The invention relates to a grandstand having a plurality of seat rows rising in a step-like appearance and being accessible via at least one access route having a plurality of steps which bridges a height difference between the seat rows.

Grandstands of this type are usually used to allow a plurality of spectators or spectators observing a sporting or cultural performance. A better view of the event may be possible due to the stepped arrangement of the spectators.

German patent DE 10 2004 045 403 B4 discloses a grandstand of the type mentioned. This known grandstand has a plurality of seat rows rising in a step-like appearance. The spectators enter the grandstand via an entrance and can pass from there to the desired seat row via a staircase or access route bridging the height difference between the rows. Since the maximum height of a step is limited on account of human anatomy and each step may not fall below a certain tread width, the rake of said staircase is limited to a maximum of approximately 36°. Since the staircase of this known grandstand rises substantially in parallel to the seat rows, the maximum rake of the seat rows can not exceed the rake of the staircase, thus the rake of the seat rows is also limited to this value of approximately 36°.

This known grandstand has the disadvantage that, as the height of the seat row increases, the distance from the location of the events also increases, thereby ensuring an unimpeded view to the playing field. As a result, the events may be followed only insufficiently from the upper rows due to the large horizontal distance of the spectators sitting in the upper rows. Furthermore, lower seat rows may form viewing obstacles to spectators sitting in the upper rows, with the result that the events of the game or play is concealed to these spectators in particular in a region adjacent to the grandstand.

The object of the invention is to specify a grandstand which allows improved viewing conditions and therefore a more intensive and/or a more direct experience of the respective performance for the spectators. Furthermore, it is an object of the invention to provide a safe access to such a grandstand.

SUMMARY

Since an access route bridging a height difference between a plurality of seat rows usually comprises a plurality of steps, the terms 'staircase' and 'access route' are interchangeably used in this description. In some embodiments of the invention, the steps are equally distributed along the tread line.

The object of the invention is solved in one embodiment by a grandstand comprising a plurality of rows being selected from the group consisting of seat rows or standing area rows or both, said rows rising in a step-like appearance and being accessible by at least one access route bridging a height difference between the rows, wherein a gradient of the rows and a gradient of the access route enclose an angle of from approximately 20° to approximately 90°, and wherein the gradient of the access route has a second component running parallel to the first gradient of the rows, and wherein the gradient of the access route has a first component running perpendicular to the gradient of the rows, said first component pointing in a direction towards the rows.

The object of the invention is solved in another embodiment by a grandstand comprising a plurality of rows being selected from the group consisting of seat rows or standing area rows or both, said rows rising in a step-like appearance and being accessible by at least one access route bridging a height difference between the rows, wherein a rake of the rows is greater than a rake of the access route.

The object of the invention is solved in still another embodiment by a grandstand comprising a plurality of rows being selected from the group consisting of seat rows or standing area rows or both, said rows rising in a step-like appearance and being accessible by at least one access route bridging a height difference between the rows, wherein a rake of the rows is selected from approximately 40° to approximately 80°.

According to the invention, a grandstand is disclosed having a plurality of rows. At least one of said rows may be equipped with a plurality of seats to form a seat row in some embodiments. A seat may be a foldable or rigid seat option being individual to each other or being interconnected to one another. In other embodiments, at least one of said rows may be equipped with a plurality of standing areas to form a standing area row. An individual standing area may have markings or structural boundaries, e.g. at least one post, at least one railing, at least one marking plate and/or at least one floor marking which indicate the size and/or the position of the respective standing area. In still another embodiment, at least one of said rows may be equipped with at least one seat and at least one standing area to form a mixed row. If the term 'row' is used in this description without further specification, it denotes seat rows, standing area rows and mixed rows in any combination, i.e. seat rows only, standing area rows only, mixed rows only, a combination of seat rows and standing area rows, a combination of seat rows and mixed rows, a combination of standing area rows and mixed rows or a combination of seat rows, standing area rows and mixed rows. In addition to conventional standing areas and conventional seats, combinations or intermediate forms are also intended to be included in the disclosure. Combinations or intermediate forms of this type can be configured, for example, in such a way that the spectator adoptes a position between an upright standing position and a normal seating position, e.g. the spectators's legs are angled less than 170° but more than 90°.

The rows are rising in a step-like appearance, i.e. at least one upper row is located higher than a preceeding lower row. In some embodiments, exactly one row may be arranged on one step, with the result that each row has a discrete height difference from the preceding row. In other embodiments of the invention, more than one row can be arranged on one step, with the result that groups of rows have a height difference from one another. In some embodiments of the invention, the height difference between two rows may be selected from approximately 10 cm to approximately 250 cm or from approximately 30 cm to approximately 200 cm or from approximately 45 cm to approximately 140 cm.

In some embodiments, a row is adapted to accommodate at least two or, in another embodiment, at least five spectators on respective seats or standing areas which are arranged next to one another on one level, that is to say horizontally in one plane. In some embodiments of the invention, all the seats or standing areas of a row are arranged on a single level. According to this embodiment, the row therefore has no height difference along its longitudinal extent.

An optional railing can be arranged between two adjacent rows, having the effect that a spectator being located in his row is hindered to climb directly to the row above or below without using the access route. In the case of great height differences between rows, a railing of this type may be required for safety reasons.

For the purposes of the present invention, the gradient of the access route denotes the direction of the steepest rise. In the case of a staircase with a rectangular step surface, the gradient therefore runs orthogonally with respect to the front edge or rear edge of the steps. If staircases or ramps are not of rectilinear design, the gradient is also not rectilinear. In this case, however, it should be clear to one of ordinary skill in the art that the gradient at a predefinable point can be specified as the direction of the tangent with respect to the gradient at that respective point. The angle of inclination of the gradient vector with respect to the horizontal plane denotes the rake of the access route. To this extent, a greater gradient is understood to describe a steeper angle of inclination, i.e. a larger rake. It should be clear to one of ordinary skill in the art that the gradient of the access route is a vector which may be described in polar coordinates, i.e. by a norm and an angle of inclination or in Cartesian co-ordinates, i.e. by three components pointing in three different directions and being perpendicular to each other.

In the same way, for the purposes of the present invention, the gradient of the rows denotes the direction of the steepest rise. In the case of a number of rows with a rectangular surface each, the gradient therefore runs orthogonally with respect to the front edge or rear edge of the rows. If a number of rows are not of rectilinear design, the gradient is also not rectilinear. In this case, however, it should be clear to one of ordinary skill in the art that the gradient at a predefinable point can be specified as the direction of the tangent with respect to the gradient at that respective point. The angle of inclination of the gradient vector with respect to the horizontal plane denotes the rake of the rows. To this extent, a greater gradient is understood to describe a steeper angle of inclination, i.e. a larger rake. It should be clear to one of ordinary skill in the art that the gradient of the rows is a vector which may be described in polar coordinates, i.e. by a norm and an angle of inclination or in Cartesian co-ordinates, i.e. by three components pointing in three different directions and being perpendicular to each other.

According to an embodiment of the invention, the gradient of the rows and the gradient of the access route enclose an angle of from approximately 20° to approximately 90° to each other. In other words, the walking direction or tread line of the access route does not run at a right angle with respect to the rows. Therefore, the gradient of the rows may differ from the gradient of the access route.

In the case of known grandstands of a first type, the gradient of the rows and the gradient of the access route are parallel to each other, i.e. the gradients enclose an angle of 0°. Therefore, the rake of the rows can not be different from the rake of the access path. As the rake of the latter is limited to 37°, the rows can not be steeper. This fact may be illustrated further by considering a second component of the gradient of the access route being parallel to the gradient of the rows and a first component of the of the gradient of the access route being perpendicular to the gradient of the rows. In known grandstands of the first type, the first component of the of the gradient of the access route is zero.

In the case of known grandstands of a second type, the gradient of the rows and the gradient of the access route are not parallel to each other, i.e. the gradients enclose an angle other than 0°. Nevertheless, in all of these known grandstands, the gradients are pointing away from one another. In contrast, the grandstand according to the invention is distinguished from these known grand stands by the fact that the gradient of the access route and the gradient of the rows are pointing towards one another. This fact may be illustrated by considering a second component of the gradient of the access route being parallel to the gradient of the rows and a first component of the of the gradient of the access route being perpendicular to the gradient of the rows. In known grandstands of the second type, the first component of the of the gradient of the access route points away from the row, i.e. a spectator running in the direction of said first component would leave his seat. In grandstands according to the invention, the first component of the of the gradient of the access route points towards a row, i.e. a spectator running in the direction of said first component would reach his seat.

The invention is based on the basic idea that a gradient of the rows and a gradient of the access route not being parallel to each other allow for an access route which may have a rake which differs from the rake of the rows. Thus, a flat access route may be combined with a steeper grandstand. In other embodiments of the invention, a flat grandstand may be provided with a steep access route, in order to make spacesaving connection of the grandstand possible. Here, the closer the angle which is enclosed by the gradient of the rows and the gradient of the access route approaches the right angle, the more differently both gradients or angles of inclination can be configured.

In some embodiments of the invention, the gradient of the rows and the gradient of the access route can enclose an angle of from approximately 50° to approximately 90°. In some embodiments of the invention, the gradient of the rows and the gradient of the access route can enclose an angle of from approximately 70° to approximately 90°. These ranges ensure that the gradient of the access route has a sufficiently large first component perpendicular to the gradient of the rows and therefore the rake of the access route can be decoupled from the rake of the rows to such an extent that the access route becomes flat enough to be walked along comfortably by the spectators and safe and rapid evacuation is made possible in case of an emergency.

In some embodiments of the invention, the grandstand can have at least one first tier having a first plurality of rows and at least one second tier having a second plurality of rows, each tier accommodating more than approximately 100 or more than approximately 200 spectators on respective seats and/or standing areas. In some embodiments of the invention, the second tier can be arranged above the first tier, i.e. offset in the vertical direction. In some embodiments of the invention, each tier can have at least one row. In another embodiments of the invention, each tier can have a plurality of rows. Two adjacent tiers can differ from two adjacent rows by an increased spacing or height difference from one another. Two adjacent tiers may have a clear structural division. In some embodiments of the invention, two different tiers may have different access routes. This means, a tier is a group of rows which contains at least one row.

In some embodiments of the invention, the grandstand can accommodate more than approximately 2000, more than 3000 or more than approximately 5000 spectators on respective seats and/or standing areas. In some embodiments of the invention, a plurality of grandstands can be combined to form a stadium which accordingly can accommodate more than 5000, more than 10000, more than 30000 or more than 40000 spectators. A plurality of grandstands can be erected such that they are statically dependent on one another or independent. Large grandstands or large stadia often suffer from the problem that a large number of rows has to be provided for the large number of spectators, with the result that, in the case of the low rake of known grandstands, the horizontal distance from the playing field or the stage becomes very large. Especially the spectators in the rear rows profit from the benefit of the grandstand according to the invention, that it can be of steeper configuration or larger rake, so that the result is a shorter spacing and an overall improved view to the events on the field or the stage. However, grandstands having a rake of the rows of more than 37° or more than 40° could not be provided up to now with known concepts, as the rake of the access path becomes to steep, the grandstand thereby missing a safe access route which is easy to walk along. It is the merit of the inventors of the present disclosure to provide for the first time a grandstand having rows with a higher rake and an access route with a lower rake.

In some embodiments of the invention, the rake of the rows rising in a step-like appearance may range from approximately 37° to approximately 80°. In other embodiments of the invention, the rake of the rows rising in a step-like appearance can range from approximately 40° to approximately 80°. In other embodiments of the invention, the rake of the rows rising in a step-like appearance can range from approximately 45° to approximately 75°. These ranges of the rake may have the effect that the spectator in the upper rows are faced to a novel, previously unknown experience of the events on the playing field adjacent to the grandstand. This is caused initially by the smaller horizontal distance and further by experiencing the steepness, allowing for an unimpeded view similar to that from a view tower.

Although the rows may have a substantially steeper configuration or larger rake than in previously known grandstands, the access route may have a low rake of approximately 36° or less as a result of the respective gradients running in different directions. In some embodiments of the invention, the rake of the access route can even be less than 32°. This allows comfortable and fear-free use of the access route, with the result that even large numbers of spectators can walk along it rapidly, without causing a line or a mass panic in the case of an emergency.

In some embodiments of the invention, the width of the access route is constant from the lowermost row to the uppermost row and the minimum width is selected according to the requirements arising from human anatomy. As a result, the overall impression of a known staircase is maintained for the spectator, with the result that said staircase can be walked pleasantly and without delays.

In some embodiments of the invention, the width of the access route may decrease from the lowermost row to the uppermost row. This embodiment of the invention takes into consideration the fact that the spectators of an upper row also have to use the staircase of the rows lying below them, in order to reach their seat order standing area. Therefore, the lower part of the access route or staircase has to accommodate a higher traffic, as the number of spectators decreases continuously from bottom to top. Accordingly, the capacity of the staircase according to this embodiment of the invention also decreases due to the decreasing width, and the additional space can be used for additional seats, standing areas or functional areas.

In some embodiments of the invention, the width of the access route can range from approximately 80 cm to approximately 300 cm. The dimension may be selected depending on the capacity of the rows and the target time needed for an evacuation. It has been shown that, depending on the size of the respective row, this width of the access route is sufficient in most cases to direct the spectator flows safely via the access route.

In some embodiments of the invention, the walking direction or tread line on the access route and the gradient of the access route can enclose an angle of from approximately 0° to approximately 60°. In other embodiments of the invention, the walking direction on the access route and the gradient of the access route can enclose an angle of from approximately 0° to approximately 30°. This means that the access route, for instance a staircase, can be walked along obliquely by the spectators. In some embodiments of the invention, this can result in a space saving configuration, thus allowing further seats or standing areas or functional areas.

According to one embodiment, the invention relates to a stadium having at least one grandstand as described herein. Here, stadium is understood generally to be a venue for sporting, cultural or other events, in which any of a playing field or a stage or an event area is enclosed by any of seats or standing areas.

BRIEF DESCRIPTION OF THE DRAWINGS

Without restricting the general concept of the invention, some aspects of the invention are to be explained in greater detail in the following text making reference to the appended drawings, in which.

DETAILED DESCRIPTION OF THE INVENTION

Figure 1:
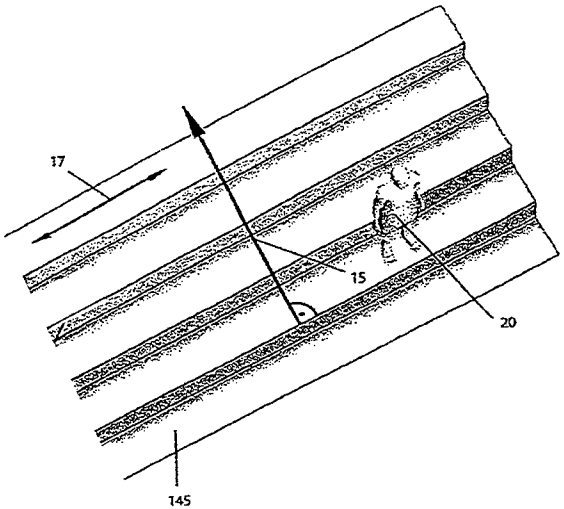
FIG. 1 illustrates the gradient of the access route and the gradient of the rows.

FIG. 1 illustrates the gradient 15 of the rows 145. The figure shows a plurality of rows 145 with one spectator 20. The latter reaches his/her seat or standing area via an access route which will be explained with respect to FIG. 2. The rows are rising in a step-like appearance, i.e. each row has a height difference from the preceding row. For the purposes of the present disclosure, the gradient 15 of the rows 145 denotes the direction of the steepest rise. In the case of rows with a rectangular step surface, the gradient therefore runs orthogonally with respect to the front edge or rear edge of the steps constituting the rows. If rows are not of rectilinear design, the gradient is also not rectilinear. In this case, however, it should be clear to one of ordinary skill in the art that the gradient at a predefinable point runs orthogonally to the direction 17 of the rows 145.

Figure 2:
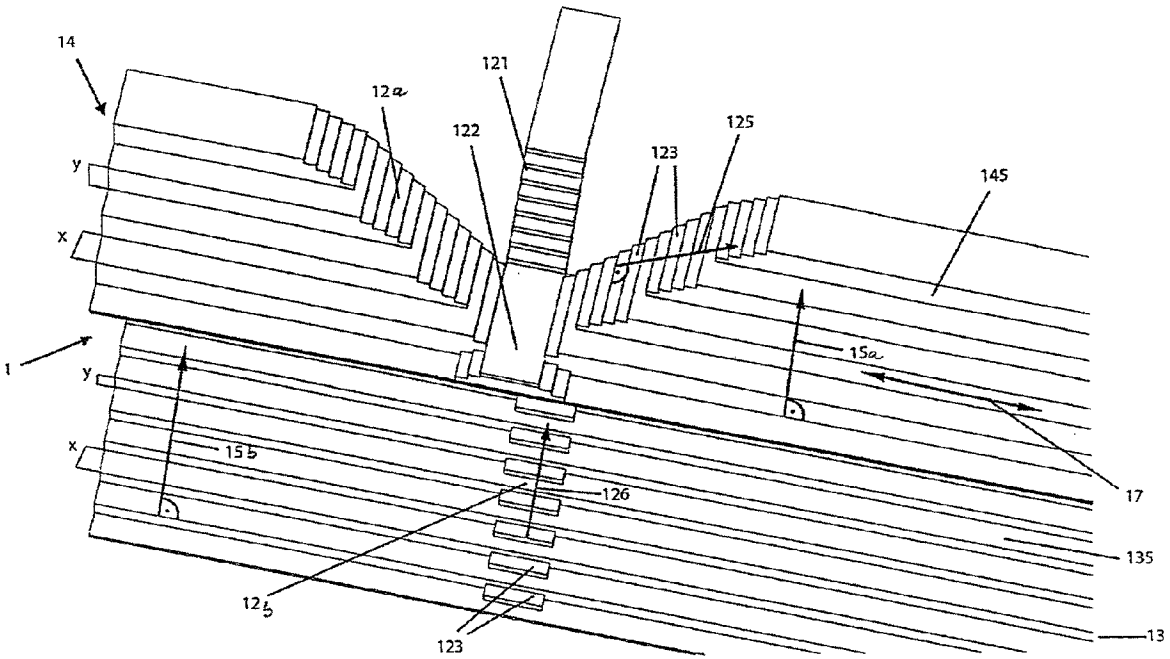
FIG. 2 illustrates a detail of a first embodiment of a grandstand having two tiers according to the invention.

FIG. 2 shows a perspective illustration of a grandstand 1 or an illustration of a detail of a larger grandstand. As can be seen from FIG. 2, the grandstand 1 has at least one lower tier 13 and at least one upper tier 14. The principle of the invention can be applied universally to seat and/or standing area rows. Which type of rows the tiers have can be selected depending on the respective application, i.e. depending on the comfort expectation of the spectators and the amount of spectators to be accommodated. Accordingly, the grandstand 1 can be equipped exclusively with standing areas, exclusively with seats, or in a combined manner with seats and standing areas.

The rows are rising in a step-like appearance, i.e. each row has a height difference y from the preceding row. In some embodiments of the invention, the value of the height difference y can be between approximately 10 cm and approximately 250 cm or between approximately 30 cm and approximately 200 cm or between approximately 45 cm and approximately 140 cm. The value of the height difference y may be identical for the lower tier 13 and the upper tier 14 or may be selected to be different.

Furthermore, each row 135 or 145 has a depth x, within which the respective seat or standing area and the necessary traffic areas are accommodated, with the result that the spectators within one row can move to their seat or standing area. The rake $\alpha$ of the grandstand or a tier thereof may be calculated as $\alpha$=arctan (y/x). In the exemplary embodiment shown, the rake of the upper tier 14 is greater than the rake of the lower tier 13, i.e. the upper tier 14 is steeper than the lower tier 13 or the gradient 15*a* of the upper tier 14 is greater than the gradient 15*b* of the lower tier 13.

In the exemplary embodiment shown, the lower tier 13 is accessed in a known way by a known access route 12*b*. Thus, the lower tier 13 is an exemplary embodiment of a known grandstand of the first type. The gradient 126 of the access route 12*b* is running parallel to the gradient 15*b* of the rows 135. This means that the rake of the access route 12*b* cannot be lower than the rake of the rows 135. Since the maximum height of a step 123 of the access route 12*b* is limited on account of human anatomy and each step 123 may not fall below a certain tread width, the rake of said access route is limited to a maximum of approximately 36°. This maximum value is due to the fact that the tread width of the steps 123 of access route 12*b* usually does not fall below 26 cm and from an average human stride length of from approximately 61 cm to 64 cm, a maximum height of the steps 123 of from 19 cm to 20 cm results. Thus, the maximum rake of the seat rows 135 of the lower tier can not exceed the rake of the access route 12*b* of the lower tier 13, so that the rake of the seat rows 135 is limited to a value of approximately 36°.

In the exemplary embodiment shown in FIG. 2, the upper tier 14 is equipped with rows 145 which may have a greater height difference y from one another compared to the rows 135. Therefore, the rows of the top tier 14 are steeper than in the lower tier 13, i.e. the rows 145 have a higher rake than the rake of the rows 135 of the lower tier 13 or the gradient 15*a* of the rows 145 of the upper tier 14 is greater than the gradient 15*b* of the rows 135 of the lower tier 13. As a result of their prominent position, the rows 145 of the upper tier 14 have a steeper line of sight to an area nearest to the grandstand 1 of the field. Due to the high rake of the rows 145, the rows 145 of tier 14 can no longer be accessed by a conventional access route 12*b* as explained in conjunction with the lower tier 13, since either the tread width of the steps 123 becomes too small or the height difference of two adjacent steps becomes too big. Despite the loss of comfort for the spectators using such a conventional access route, there is also a safety risk in case of an emergency, since the spectators might stumble easily on a steep staircase and rapid evacuation of the grandstand is no longer ensured.

As can be seen on the upper tier 14 shown in FIG. 2, the gradient 125 of the access route 12*a* according to the invention runs approximately perpendicular to the gradient 15*a* of the rows 145. As a result, the access route 12*a* may have a different rake than the rows 145, with the result that a comfortable and safe access route 12*a* can be provided to access the steeper rows 145 of the upper tier 14.

In order to reach the rows 145, the spectators have to walk via a first access route 121 to a stair head 122. It has to be noted that the shown position of the stair head 122 at the level between the first and the second rows 145 is optional. The stair head 122 may be arranged at a higher or lower level in different embodiments of the invention.

In the embodiment shown, four access routes 12*a* branch off from the stair head 122 in the directions 17 of the rows 145. The rows located to the left of the stair head 122 are connected by two respective access routes 12 and the rows located to the right of the stair head 122 are connected by two respective access routes 12*a*. This means that two of said access routes 12*a* run upward and two of said access routes run downward, with the result that all the rows 145 can be accessed from said stair head 122. In the case of a different position of the stair head 122, it should be clear to one of ordinary skill in the art that some of the shown four access routes 12*a* may be omitted or additional access routes may be added. In some embodiments of the invention, one access route connects at least 2 rows. In some embodiments of the invention, one access route connects at least 4 rows. In some embodiments of the invention, one access route connects at least 5 rows.

The principle shown in FIG. 2 for a tier 14 with 8 rows can be extended to larger tiers 14, the tier 14 being connected by a plurality of access routes 12*a* and optionally by a plurality of stair heads 122 each accessing a group of several rows 145.

The access routes 12*a* of tier 14 each are running approximately perpendicular with respect to the walking direction on the first access route 121. The walking direction on the access route 12*a* of the rows 145 follows approximately the gradient 125 of the access route 12*a*. Therefore, other than on the lower tier 13, the height difference y between the rows 145 is not overcome in the direction of the gradient 15 of the rows 145, but orthogonally with respect thereto.

It should be clear to one of ordinary skill in the art that the aspect of the invention which has been explained by way of example using FIG. 2 and the upper tier 14 illustrated thereon may also be implemented successfully when the gradient 125 of the access route 12*a* does not run exactly orthogonally to the gradient 15 of the rows 145 or the walking direction on the access route 12*a* is not parallel to the gradient 125 of the access route 12. In these cases, the gradient 15 of the standing area rows 145 and the gradient of the access route 12 may enclose different angle, being selected from approximately 20° to approximately 90°, or approximately 45° to approximately 90°, or approximately 70° to approximately 90°.

It should be clear to one of ordinary skill in the art that the construction principle which is explained by way of example using rows 145 in the tier 14 may also be applied to rows 135 in the tier 13.

Figure 3:
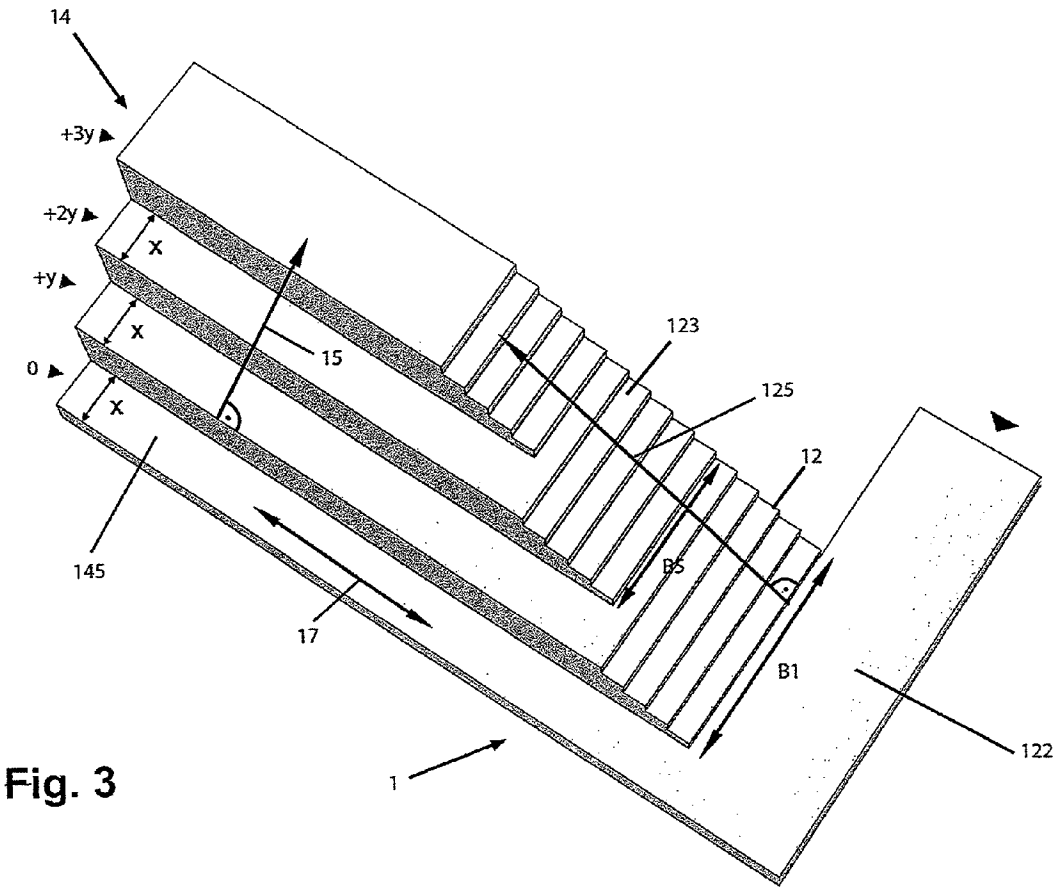
FIG. 3 illustrates a detail of a second embodiment of a grandstand according to the invention.

FIG. 3 illustrates a detail of a second embodiment of a grandstand according to the invention. FIG. 3 shows a tier 14 or a grandstand with four rows 145. Each row has a height difference of the amount y from the preceding row, with the result that the uppermost row has a height difference of 3y from the lowermost row. Furthermore, each row 145 has a width x which is dimensioned such that the spectators can stand or sit comfortably on the rows and are able pass one another without danger when populating or evacuating the rows. The length of the rows along their longitudinal extent 17 is dimensioned such that each spectator can use a sufficiently large area for his respective standing area or seat. For example, the longitudinal extent may be selected from approximately 0.5 m to approximately 0.75 m per spectator.

The ratio of the height difference y between the standing area rows 145 and the width x gives the rake $\alpha$ or the gradient 15 of the rows 145. Thus, the gradient 15 indicates the direction of the steepest rise. In the case of rectangular steps, the gradient 15 therefore runs orthogonally with respect to the longitudinal extent 17 of the respective standing area rows 145.

An access route 12 according to the invention is provided to guide the spectators to their seats. The access route 12 begins at a substantially flat path or a stair head 122. The access route 12 overcomes the height difference y between the individual rows 145 by means of a plurality of steps 123. The access route 12 thus also has a gradient 125 which runs orthogonally with respect to the respective edge of the rectangular steps 123. As FIG. 3 illustrates, the gradient 125 of the access route 12 is therefore arranged substantially perpendicular to the gradient 15 of the rows 145.

In the example shown, the access route 12 is configured as a staircase. The staircase can have more than 3, more than 6 or more than 10 steps.

Since the spectators of the upper rows have to use all the stairs which the spectators of the lower rows also have to climb, the width of the access route 12 increases from top to bottom. By way of example, the width B1 of the first step and the width B5 of the fifth step are shown. It can be seen readily that a smaller width of the access route 12 is appropriate at the level of the fifth step, since only the spectators of the second, and third row move along the access route 12 here. In contrast, the access route is of wider configuration in the region of the first step, since additionally the spectators of the first rows also move along the access route 12 in this lower section. This feature allows increasing the capacity of the access route 12 without wasting space, since the access route is configured with a full width only in the sections where the flow of people is at a maximum.

Figure 4:
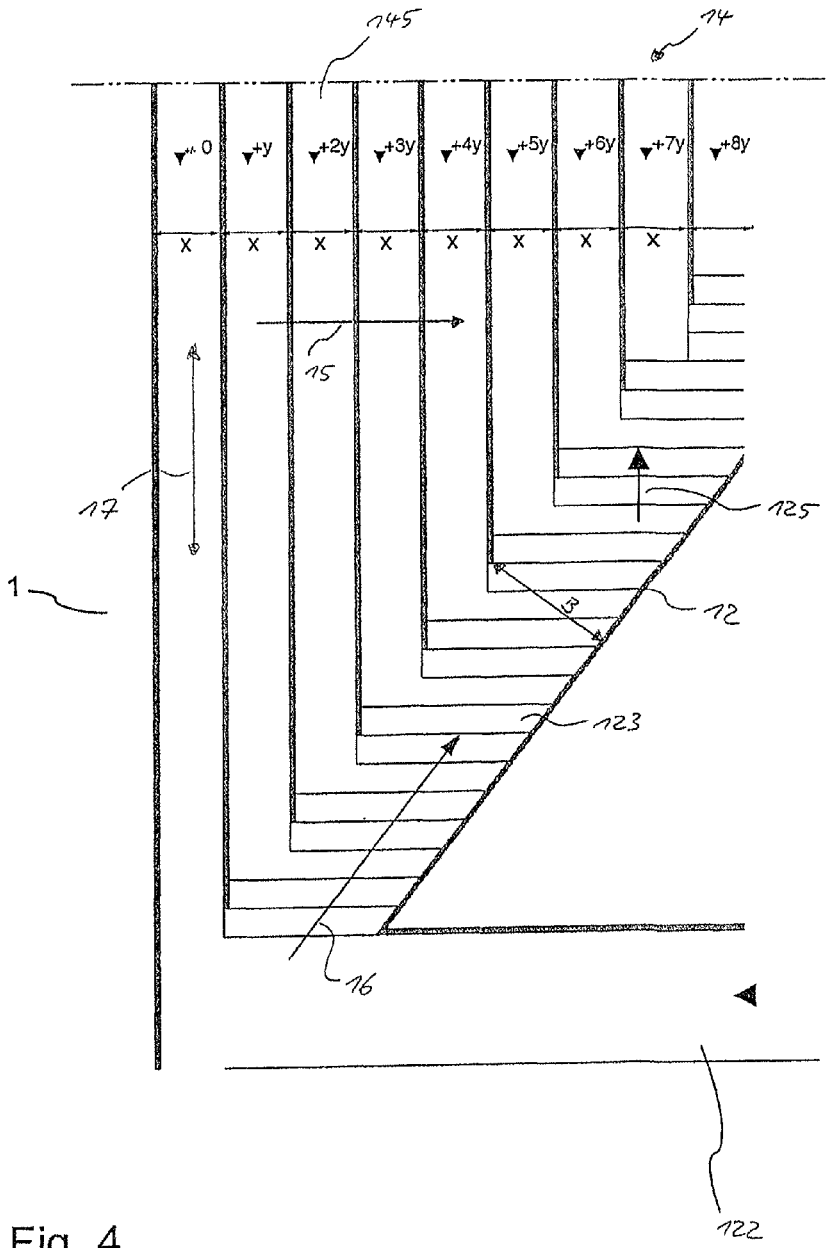
FIG. 4 illustrates a detail of a third embodiment of a grandstand according to the invention.

FIG. 4 illustrates a detail of a third embodiment of a grandstand according to the invention. Like reference numbers are used for like features. Thus, the following description is limited to the differences to the other embodiments shown.

An access route 12 allowing access to rows 145 starts at a stair head 122. The width is selected such that a rapid evacuation and population of the grandstand 1 or the tier 14 is possible. Since the upper rows 145 are shorter than the lower rows, the flows of people increases from top to bottom during evacuation.

The gradient 125 of the access route 12 runs approximately orthogonally with respect to the gradient 15 of the rows 145. However, the walking direction 16 of the spectators on the access route 12 is not parallel to the gradient 125 of the access route 12. In the exemplary embodiment shown, the walking direction 16 and the gradient 125 enclose an angle of 38°. Said angle may be selected differently in different embodiments. In some embodiments of the invention, the angle may be selected to range from approximately 0° to approximately 60°. In some embodiments of the invention, the angle may be selected such that a safe and comfortable walk on the access route 12 is possible.

Figure 5:
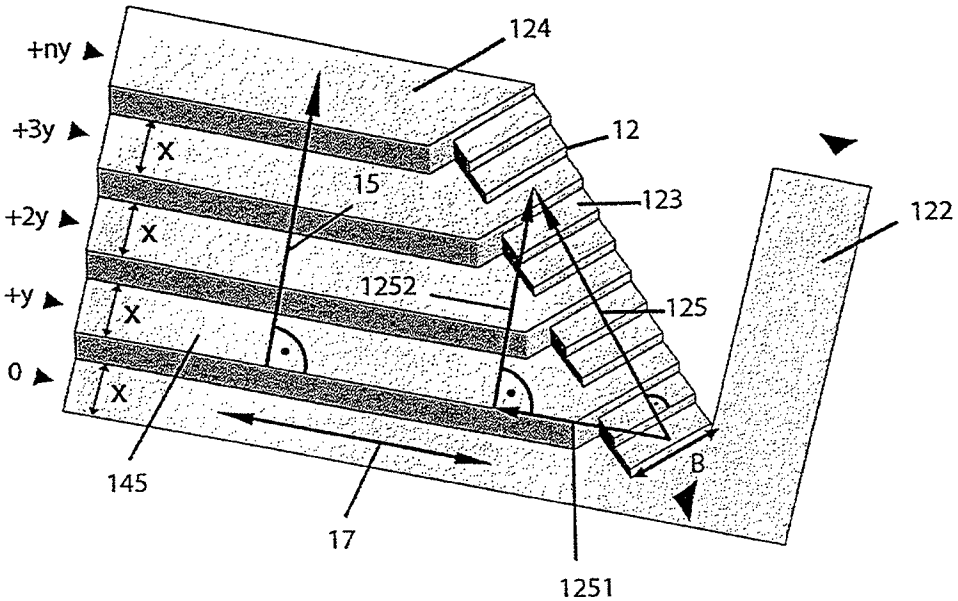
FIG. 5 illustrates a detail of a fourth embodiment of a grandstand according to the invention.

FIG. 5 illustrates a detail of a fourth embodiment of a grandstand according to the invention. FIG. 5 shows five rows 145 as explained previously. In contrast to the preceding exemplary embodiments, the gradient 125 of the access route 12 encloses an angle with the gradient 15 of the rows 145 which is different from a right angle. In the exemplary embodiment shown, an angle of 53° is selected. It should be clear to one of ordinary skill in the art that this value has been choosen by way of example only and the angle may vary in other embodiments of the invention. The invention requires only that the gradient 125 has at least a first component 1251 being perpendicular to the gradient 15 of the rows 145 and an optional second component 1252 being parallel to the gradient 15 of the rows 145.

In the fourth embodiment of a grandstand according to the invention, the spectators pass via a stair head 122 to the access route 12. By means of the steps 123 of the access route 12, the spectators climb essentially on the direction of the gradient 125 until they reach their respective rows 145. They leave the access route 12 there, in order to pass to a respective second stair head 124. The latter is situated at the level of the respective row 145, with the result that the spectators can subsequently follow said row horizontally until reaching their seat or standing area.

The access route 12 according to the fourth exemplary embodiment also has a constant width B. This fourth embodiment has the advantage that it may be more spacesaving so that less space is wasted which may be used for additional seats, additional standing areas, or traffic areas.

In all the described embodiments of the invention, the access route 12 does not necessarily have to be provided with steps 123. In other embodiments of the invention, the access route 12 may also be a stepless ramp which can comfortably used, for example, by wheelchairs or strollers.

If the access route 12 has steps 123, it can have more than 3, more than 6 or more than 10 steps.

It should be clear to one of ordinary skill in the art that the invention is not restricted to the embodiments shown in the figures. The above description is therefore not to be considered to be limiting, but rather explanatory. The following claims are to be understood such that the stated feature is present in at least one embodiment of the invention. This does not exclude the presence of further features. If the claims or the description describe "first" and "second" elements, this designation is used to distinguish similar features, without an order of precedence being defined.

The invention claimed is:

1. A grandstand comprising a plurality of seat rows rising in a step-like appearance and being accessible via at least one access route bridging a height difference between the seat rows, wherein a gradient of the seat rows and a gradient of the access route enclose an angle of from approximately 20° to approximately 90°, and wherein the gradient of the access route has a second component which runs parallel to the gradient of the seat rows and wherein the gradient of the access route has a first component which runs perpendicular to the gradient of the seat rows and points towards the seat rows.

2. The grandstand as claimed in claim 1, wherein more than one seat row is accessible by way of a contiguous staircase as an access route.

3. The grandstand as claimed in claim 1, wherein the gradient of the seat rows and the gradient of the access route enclose an angle of from approximately 50° to approximately 90°.

4. The grandstand as claimed in claim 1, wherein the gradient of the seat rows is different from the gradient of the access route.

5. The grandstand as claimed in claim 4, wherein the gradient of the seat rows is greater than the gradient of the access route.

6. The grandstand as claimed in claim 1, wherein the grandstand has at least one first tier having a plurality of seat rows and at least one second tier having a plurality of seat rows, and a tier has more than approximately 100 seats.

7. The grandstand as claimed in claim 1, comprising more than approximately 3000 seats.

8. The grandstand as claimed in claim 1, wherein the rake of the seat rows rising in a step-like appearance is selected from approximately 37° to approximately 80°.

9. The grandstand as claimed in claim 1, wherein the rake of the access route is less than 37°.

10. The grandstand as claimed in claim 1, wherein the width of the access route decreases from the lowermost seat row to the uppermost seat row.

11. The grandstand as claimed in claim 1, wherein the width of the access route remains constant from the lowermost seat row to the uppermost seat row.

12. The grandstand as claimed in claim 11, wherein the width of the access route is from approximately 80 cm to approximately 300 cm.

13. The grandstand as claimed in claim 1, wherein a walking direction of the access route and the gradient of the access route enclose an angle of from approximately 0° to approximately 60°.

14. The grandstand as claimed in claim 1, wherein the gradient of the access route has a second component parallel to the gradient of the seat rows and a first component perpendicular to the gradient of the seat rows, wherein the second component is smaller than the first component.

15. The grandstand as claimed in claim 1, wherein all the seats of a single seat row are arranged next to one another on one level.

16. The grandstand as claimed in claim 1, wherein the seat row is of horizontal configuration.

17. A grandstand comprising a plurality of seat rows which rise in a step-like manner and are accessible via at least one access route which bridges an height difference between the seat rows, wherein a rake of the seat rows is greater than a rake of the access route.

18. The grandstand as claimed in claim 17, wherein the rake of the seat rows is selected from approximately 37° to approximately 80°.

19. The grandstand as claimed in claim 17, wherein the rake of the access route is less than 37°.

20. The grandstand as claimed in claim 17, wherein the seat row has no height difference along its longitudinal extent.

21. The grandstand as claimed in claim 17, wherein the seat row contains at least two seats which are arranged next to one another on one level.

22. A grandstand comprising a plurality of seat rows rising in a step-like manner and being accessible via at least one access route bridging a height difference between the seat rows, wherein a rake of the seat rows is selected from approximately 40° to approximately 80° wherein the seat row comprises at least two seats being arranged next to one another on one level, and wherein the rake of the space rows is greater than the rake of the access route.

23. The grandstand as claimed in claim 22, wherein the rake of the access route is less than 37°.

24. The grandstand as claimed in claim 22, wherein more than one seat row is accessible by means of a contiguous staircase as access route.

25. The grandstand as claimed in claim 22, wherein a gradient of the seat rows and a gradient of the access route enclose an angle of from approximately 50° to approximately 90°.

26. A stadium comprising at least one grandstand as claimed in claim 1.

* * * * *